US008209879B2

(12) United States Patent
Chernetski et al.

(10) Patent No.: US 8,209,879 B2
(45) Date of Patent: Jul. 3, 2012

(54) METHOD FOR REMOVING CHEMISTRY BUILDUP IN A DISPENSING DRYER

(75) Inventors: Fredrick E. Chernetski, Saint Joseph, MI (US); Michael T. Dalton, Saint Joseph, MI (US); Kaustav Ghosh, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 355 days.

(21) Appl. No.: 12/489,539

(22) Filed: Jun. 23, 2009

(65) Prior Publication Data

US 2010/0000115 A1 Jan. 7, 2010

Related U.S. Application Data

(60) Provisional application No. 61/077,511, filed on Jul. 2, 2008.

(51) Int. Cl.
*F26B 7/00* (2006.01)

(52) U.S. Cl. ..... 34/389; 34/418; 34/497; 8/158; 68/17 R; 68/207; 510/328; 510/300

(58) Field of Classification Search ..... 34/380, 34/381, 389, 413, 418, 497; 510/300, 328; 8/158; 68/17 R, 207
See application file for complete search history.

(56) References Cited

U.S. PATENT DOCUMENTS

| | | | | |
|---|---|---|---|---|
| 2,694,867 | A * | 11/1954 | Smith | 34/605 |
| 3,309,783 | A * | 3/1967 | Worst | 34/553 |
| 3,650,816 | A | 3/1972 | Rudy et al. | |
| 5,555,645 | A | 9/1996 | Joslin | |
| 6,151,795 | A | 11/2000 | Hoffman et al. | |
| 6,643,953 | B2 | 11/2003 | Song et al. | |
| 2006/0005584 | A1 | 1/2006 | Schultheis et al. | |
| 2006/0254082 | A1 | 11/2006 | Kim | |

FOREIGN PATENT DOCUMENTS

| | | | |
|---|---|---|---|
| DE | 19619603 | A1 | 11/1997 |
| DE | 10014718 | A1 | 10/2001 |
| DE | 10302866 | A1 | 8/2004 |
| DE | 102006003416 | A1 | 7/2007 |
| EP | 1790769 | A1 | 5/2007 |
| WO | 2008038887 | A1 | 4/2008 |

OTHER PUBLICATIONS

German Search Report for DE102009030286, Feb. 7, 2012.

* cited by examiner

*Primary Examiner* — Stephen M. Gravini
(74) *Attorney, Agent, or Firm* — Clifton G. Green; McGarry Bair PC

(57) ABSTRACT

A method for operating a dispenser dryer to remove treating chemistry in the dispenser dryer.

20 Claims, 11 Drawing Sheets

METHOD FOR REMOVING CHEMISTRY BUILDUP IN A DISPENSING DRYER

CROSS-REFERENCE TO RELATED APPLICATIONS

This application claims priority from U.S. Provisional Application No. 61/077,511 filed on Jul. 2, 2008, entitled A METHOD FOR REMOVING CHEMISTRY BUILDUP IN A DISPENSING DRYER hereby incorporated by reference.

BACKGROUND OF THE INVENTION

Dispensing dryers, while known, are still an uncommon type of clothes dryer, which dispense a treating chemistry onto a load of laundry during a drying cycle of operation. The treating chemistry may be any chemistry applied to the laundry such as water, bleach, perfume, softener, stain guard, anti-wrinkling or the like. Spraying may be used to deliver the treating chemistry from a dispensing system to the drying chamber.

SUMMARY OF THE INVENTION

The invention relates to a method for operating a dispenser dryer to remove treating chemistry in the dispenser dryer.

DESCRIPTION OF THE PREFERRED EMBODIMENT

Figure 1:
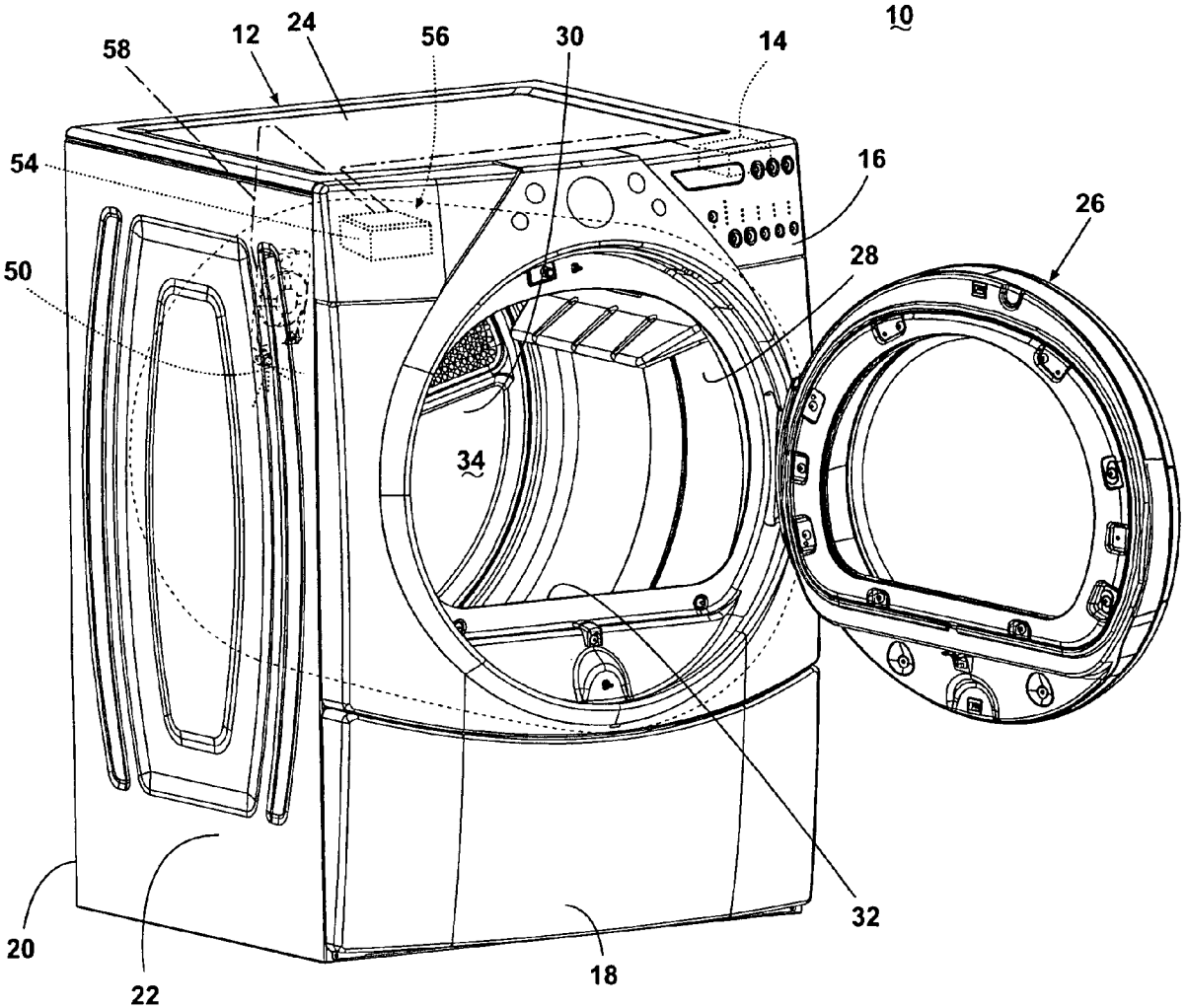
FIG. 1 is a front perspective view of a dryer having its operation controlled by the method according to one embodiment of the invention.

Referring to FIG. 1, an embodiment of a dispensing dryer 10 according to the invention. The dispensing dryer 10 described herein shares many features of a traditional automatic clothes dryer, and will not be described in detail except as necessary for a complete understanding of the invention. Although the dispensing dryer 10 may be illustrated as a front-loading dryer, the dispensing dryer may also be a top-loading dryer, as well as a combination washing machine and dryer; a tumbling or stationary refreshing/revitalizing machine; an extractor; a non-aqueous washing apparatus; and a revitalizing machine.

The dispensing dryer 10 may be illustrated comprising a cabinet 12 carrying a controller 14 that may receive input from a user through a user interface 16 for controlling the operation of the dispensing dryer 10. The controller 14 may be a well-known control device, such as a microprocessor having memory for storing digital data obtained from the output of sensors and the user interface 16.

The user interface 16 may have any number of features common to a user interface 16, including but not limited to a power button, dryer status indicator lights, parameter adjusting buttons and dials, a display, and start and stop buttons. These features may be marked with appropriate indicia to indicate their function. Selecting the cycle of operation may require a user to manipulate several of these features to initiate operation and specify common cycle parameters. Examples of such parameters include, but are not limited to cycle type, treatment type, heat level, dryness level, air level, temperature, and cycle length.

Typically, the dispensing dryer 10 will offer the user a number of pre-programmed cycles of operation to choose from, and each pre-programmed cycle of operation may have any number of adjustable parameters. The cycle of operation may be a treating cycle, a drying cycle, a combination treating and drying cycle, or any other cycle of operation provided by the dispensing dryer 10. Throughout the cycle of operation, the operational status of the dispensing dryer 10 may be reflected on the user interface 16 so as to visually inform the user of the status of the dispensing dryer 10, or to request that the user interact with the dispensing dryer 10.

The cabinet may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall, which provides access to the interior of the cabinet.

A rotatable drum 28 may be disposed within the interior of the cabinet 12 between opposing stationary rear and front bulkheads 30 and 32, which collectively define a drying chamber 34, for drying laundry, having an open face that is selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the dispensing dryer 10.

The drum 28 may be in the form of a rotatable cylinder having rear and front edges that may be received within sealed channels of the rear and front bulkheads 30 and 32. The front bulkhead 32 may have an opening that aligns with the open face of the front wall 18. The drum 28 may have a circumference larger than that of the door 26 such that part of the front bulkhead 32 covers a portion of the front face of the drum 28. Thus, when the door 26 may be in a closed position, it closes the face of the cabinet 12 and not the entire face of the drum 28. However, the drum 28 may be considered to be closed when the door 26 is in the closed position.

Figure 2:
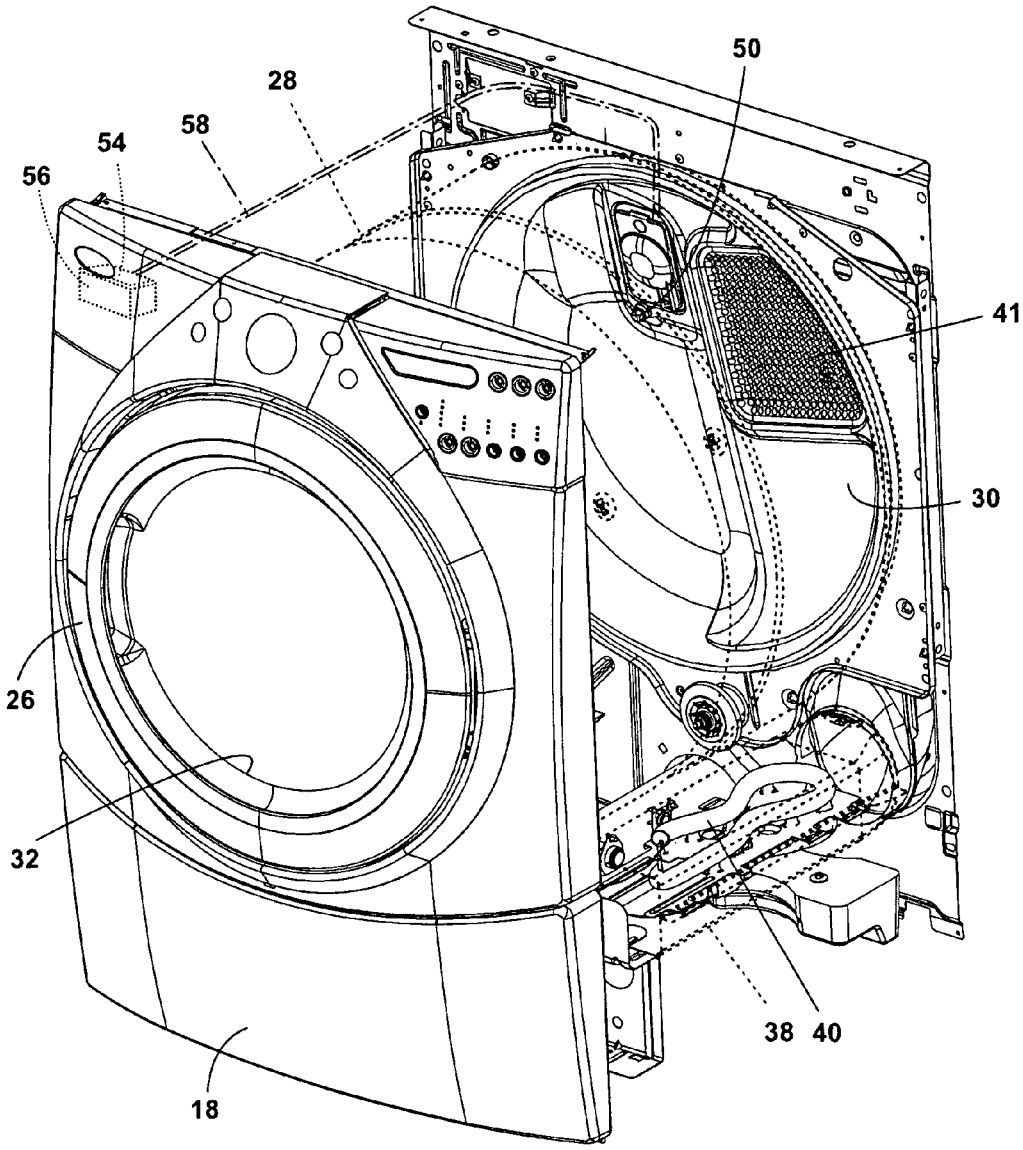
FIG. 2 is a partial perspective view of the dryer of FIG. 1 with portions of the cabinet removed and having its operation controlled by the method.

Referring now to FIG. 2, an airflow system is provided for flowing air, heated or not, through the drying chamber 34. The airflow system may have an inlet conduit 38 that supplies air to the drying chamber 34 through an inlet grill 44 located in the rear bulkhead 30. The airflow system may also have an exhaust conduit 42 through which the air is exhausted from the drying chamber 34. The air may exit the drying chamber 34 through a lint filter 46 that is located on the front bulkhead 32, to a standard exhaust fitting. A heater assembly 40 may be located in the inlet conduit 38 to heat the air provided to the drying chamber 34. A blower 36 may be located in the outlet conduit 42 to draw air through the inlet conduit 38, into the drying chamber 34, and out the exhaust conduit 42.

As described, the inlet conduit 38 couples to the rear bulkhead 30 and the exhaust conduit 42 couples to the front bulkhead 32. However, other flow paths are possible as well as other arrangements of the blower 36 and heater assembly 40. Both the heater assembly 40 and the blower 36 may be connected to the controller 14 by various control leads.

Figure 3:
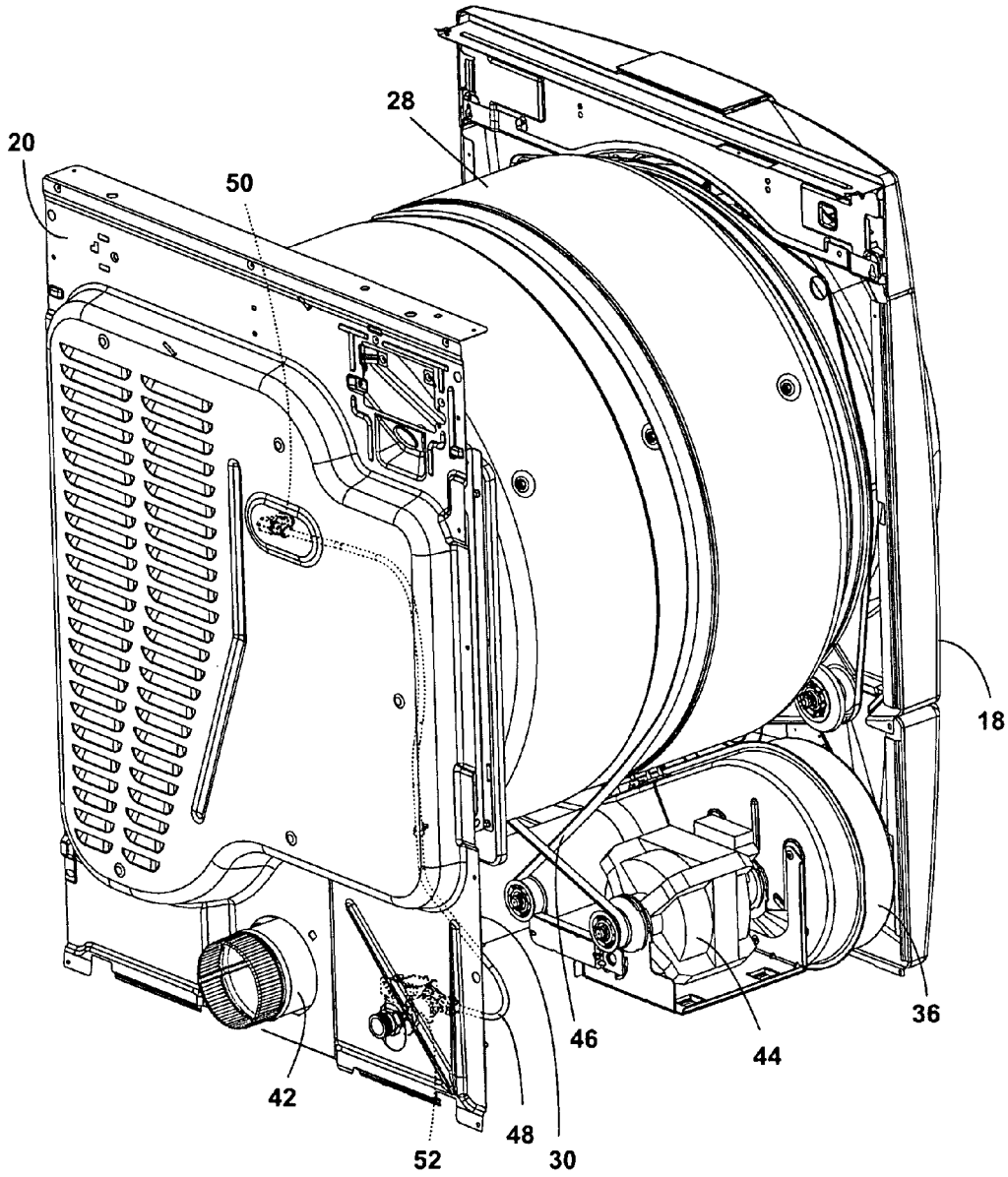
FIG. 3 is a second partial perspective view of the dryer of FIG. 1 with the drum and portions of the cabinet removed and having its operation controlled by the method.

Referring to FIG. 3, a motor 44 is coupled by an endless drive belt 46 to the drum 28. The motor 44 rotates the drum 28, which may be adapted to hold a load of laundry for drying, through the endless drive belt 46. The controller 14 operably couples the motor 44 and may cause the drum 28 to rotate in a forward direction or a reverse direction during a drying cycle. During a drying cycle, the controller 14 may also operate the drum 28 to rotate either in first one direction and then a second direction, or to stop the drum from rotating and start it rotating again in either the same or opposite direction. Additionally, the motor speed may be varied to vary the speed of rotation of the drum 28.

An optional water supply line 48 fluidly couples to a dispenser 50 through a water supply pump 52. Water may or may not be supplied to the dispenser 50 depending on the specific cycle of operation being carried out by the dispensing dryer 10. The amount of water supplied to the dispenser 50 may be regulated by the water supply pump 52, which may be operated by the controller 14. The water supply line 48 may be fluidly connected to a water supply such as a home water supply line (not shown).

Figure 4:
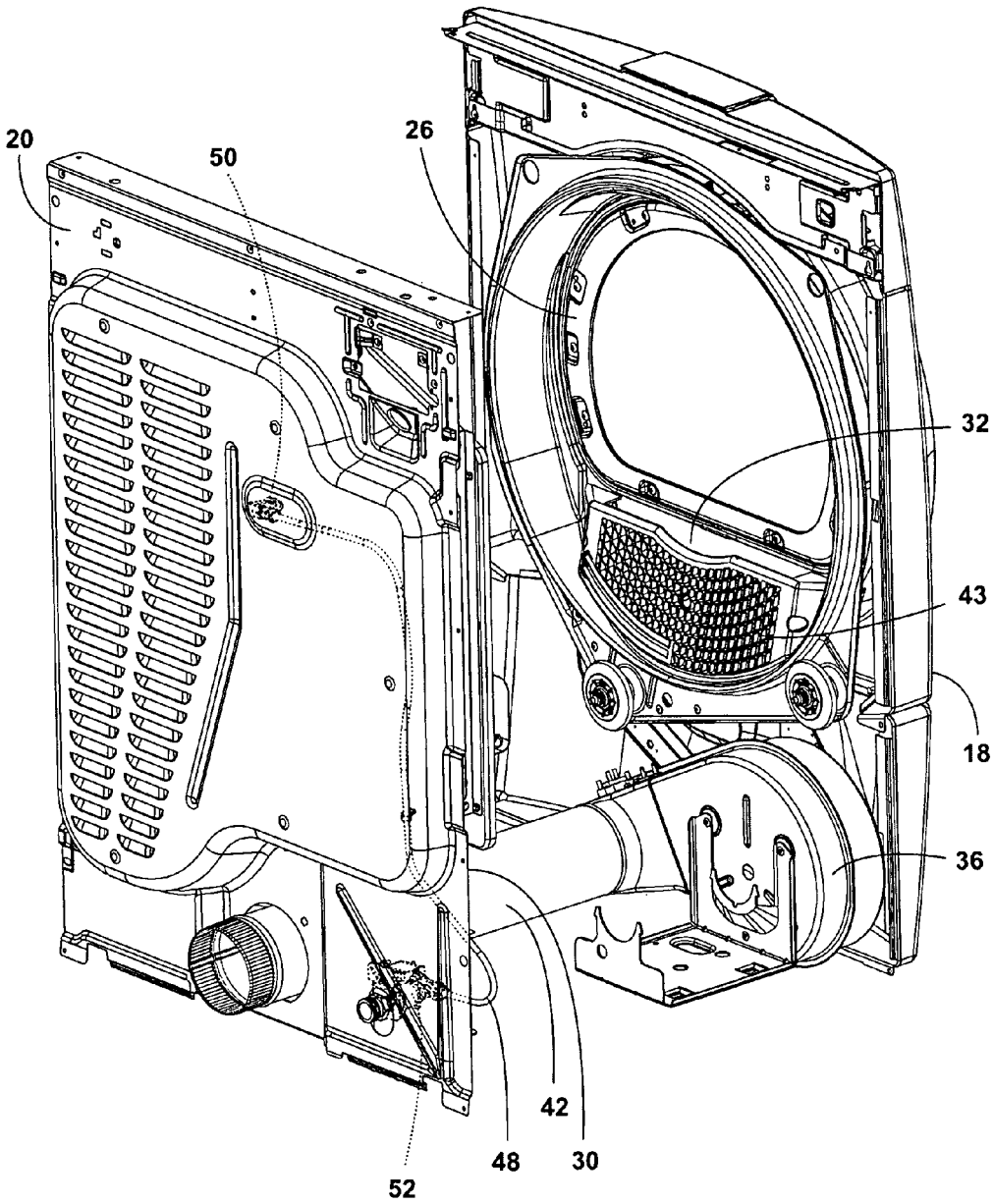
FIG. 4 is a third partial perspective view of the dryer of FIG. 1 with the drum and portions of the cabinet removed and having its operation controlled by the method.

Referring to FIG. 4, the dispensing dryer 10 may also have a dispensing system which may include a reservoir 54 capable of holding treating chemistry and closed by a lid 56 and a dispenser 50 that fluidly couples the reservoir 54 through a dispensing line 58 and the drying chamber 34. Chemistry may be delivered to the dispenser 50 from the reservoir 54 and then the dispenser 50 may dispense the chemistry into the drum 28. A chemistry meter (not shown) may electronically couple, wired or wirelessly, to the controller 14 to control the amount of treating chemistry dispensed.

The type of dispenser 50 is not germane to the invention. Any suitable dispenser will work. The dispenser 50 may be a rigid nozzle or may be a flexible nozzle constructed of a material such as silicone or polyethylene. It may be readily understood that the type of dispenser and the number of dispensers may be changed. For example, there may be any number of nozzles positioned to direct the chemistry into the drying chamber 34. Furthermore, the dispenser 50 may be movable to provide improved coverage of the inner surface of the drum 28. In addition to nozzles, other types of dispensers may be used, such as misters, nebulizers, steamers, or any other outlet that produces a spray. The dispenser 50 may dispense the chemistry as a continuous stream, a mist, an intermittent stream, or various other spray patterns.

The dispenser 50 may be mounted at the back of the drum 28 on the rear bulkhead 30. Alternatively, the dispenser 50 may be positioned adjacent to an access opening of the drum and may be directed upwardly at the inner surface of the drum 28. It may be readily understood that the position of the dispenser 50 may be changed as long as the dispenser 50 may be able to direct the chemistry at the inner surface of the drum 28 so that laundry may contact and absorb the chemistry, or so that the dispenser 50 may dispensing the chemistry directly onto the laundry in the drying chamber 34. For example, the dispenser may provide a directed spray at the drum surface using a first pressure or a mist spray that disperses the chemistry into the drum using a second pressure, less than the first pressure.

The chemistry dispensed by the dispenser 50 that does not directly contact the laundry may form a band of droplets, covering the inner surface of the drum 28, the surfaces of the rear and front bulkheads 30 and 32, and the door 26. Once the band of droplets may have been formed, the laundry falls against these droplets and absorbs them from the inner surface of the drum 28, the surfaces of the rear and front bulkheads 30 and 32, and the inner surface of the door 26. However, not all of the droplets may be absorbed and residual chemistry may be left on the drum 28, the surfaces of the rear and front bulkheads 30 and 32, and the inner surface of the door 26.

Figure 5:
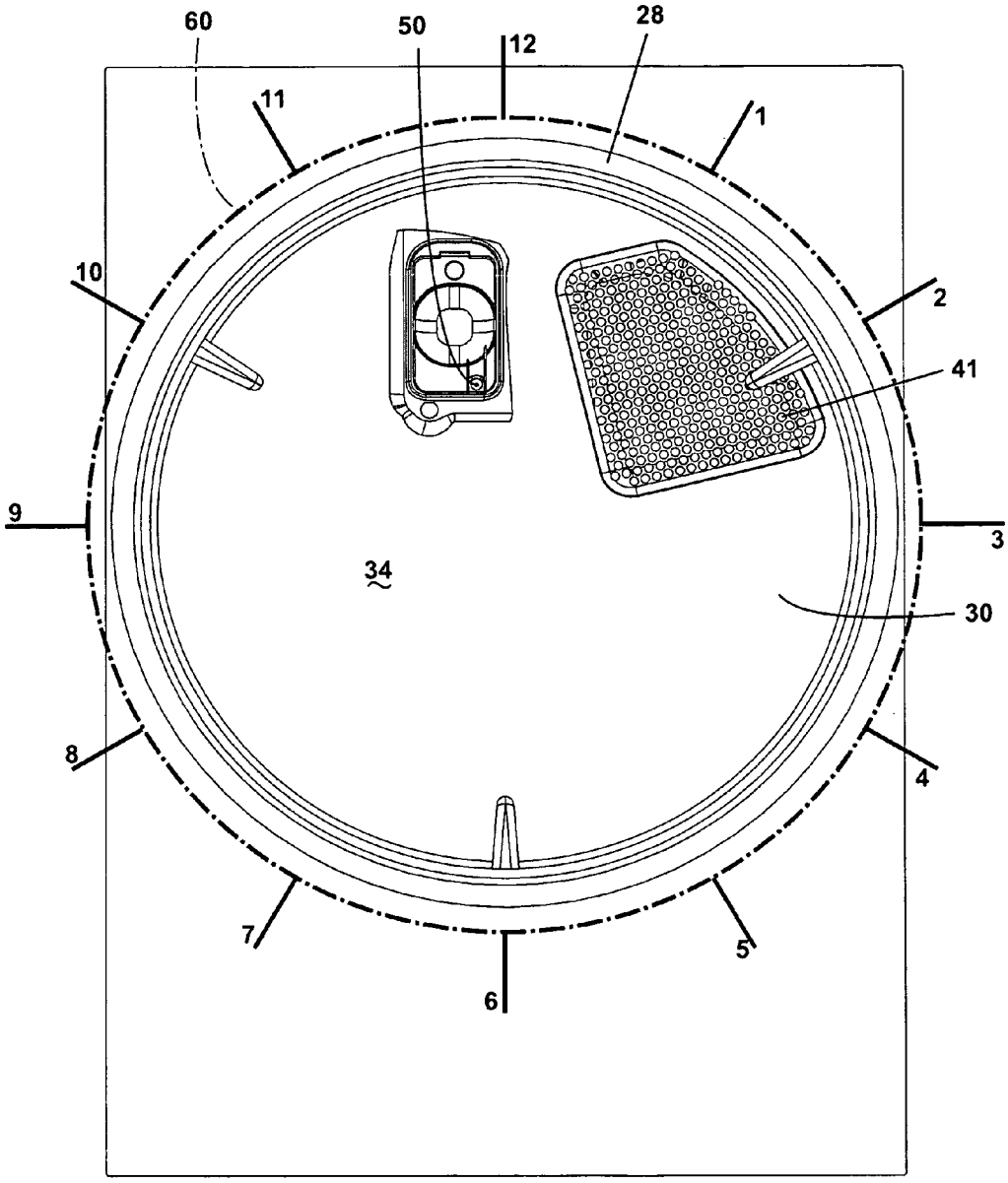
FIG. 5 is a first schematic view of the rear bulkhead of the dryer of FIG. 1 and having its operation controlled by the method.

Referring to FIG. 5, the drum 28 may have a circular cross section that bounds a circular area of each of the front and rear bulkheads 32 and 30. A conceptual clock face 60 may be imposed where the drum 28 meets the rear bulkhead 30. The conceptual clock face 60 has a 12 o'clock (represented with a 12) at the high point of the drum near the rear bulkhead 30 and 6 o'clock (represented with a 6) at the low point of the drum relative the rear bulkhead 30. Additionally, the other numbers of the conceptual clock are shown for reference. The conceptual clock face 60 will be useful in understanding the operation of the embodiment of the invention.

In normal operation of the dispensing dryer 10, a user first selects an appropriate cycle of operation by means of the user interface 16. In accordance with the user-selected parameters input at the user interface 16, the controller 14 may control the operation of the rotatable drum 28, the blower 36, the heater assembly 40, and the dispensing of water or another treating chemistry through the dispenser 50, to implement a drying cycle stored in the controller 14 to dry or treat the laundry.

During an exemplary drying cycle in which treating chemistry may be dispensed when appropriate, the motor 44 rotates the drum 28 via the endless drive belt 46. The blower 36 draws air through the inlet conduit 38 and then circulates the air through the heater assembly 40 to heat the air. The heated air may then be propelled through the inlet grill 41 and into the drying chamber 34. Air may be vented through the lint filter 43 and exhaust conduit 42 to remove moisture from the drying chamber 34. This cycle continues according the selected parameters. The motor 44, blower 36, and heater assembly 40 may operate independently during the cycle of operation.

Treating chemistry may be dispensed into the drying chamber 34 during the drying cycle. The laundry may also be tumbled, heated, or otherwise treated while the treating chemistry is dispensed. Preferably, during the dispensing step the drum 28 rotates thereby tumbling the laundry within the drum 28 and promoting even distribution of the treating chemistry. The tumbling may be continuous or in multiple, separate segments. The tumbling may also be one or multiple rotational directions, or alternate between the multiple rotational directions. The rotational direction of rotation may be the same for each segment or may be varied for each segment. The duration of each segment may vary.

The speed of rotation may be constant or varied for the entire drying cycle. A typical rotational speed is at a rate where the laundry will tumble within the drying chamber 34. That is, the speed is less than a satellizing speed where the laundry items are held against the interior surface of the drum by centrifugal force throughout a complete rotation. For the illustrated embodiment, the speed of rotation to tumble the laundry items is about 48 RPM. However, this speed will vary from machine to machine and is dependent on the physical characteristics of the drum as well as other design features and desired results.

While the drum is rotated at a predetermined speed, in reality, the actual drum speed deviates from the predetermined speed due to a variety of factors, including the size of the drum 28, inertia due to load size, and eccentricities due to load unbalances. However, as shown in FIG. 6, at this speed a laundry article will rotate with the drum 28 from a location corresponding to approximately the 6 o'clock position in the drum 28 and will detach from the drum and fall downward when the article reaches a location corresponding to approximately the 11 o'clock position in the drum 28.

When the article detaches at the 11 o'clock position it is released such that it falls in front of the inlet grill 41 and in the flow of air through the drying chamber 34. Air enters the drying chamber 34 from the inlet conduit 38 through the inlet grill 41. Air then flows through the drying chamber 34 where it is then pulled through the lint filter 43 located in the lower portion of the front bulkhead 32 by the blower 36. Once the air is removed from the drying chamber 34, it may be exhausted through the exhaust conduit 42 and into a household vent line (not shown).

Figure 6:
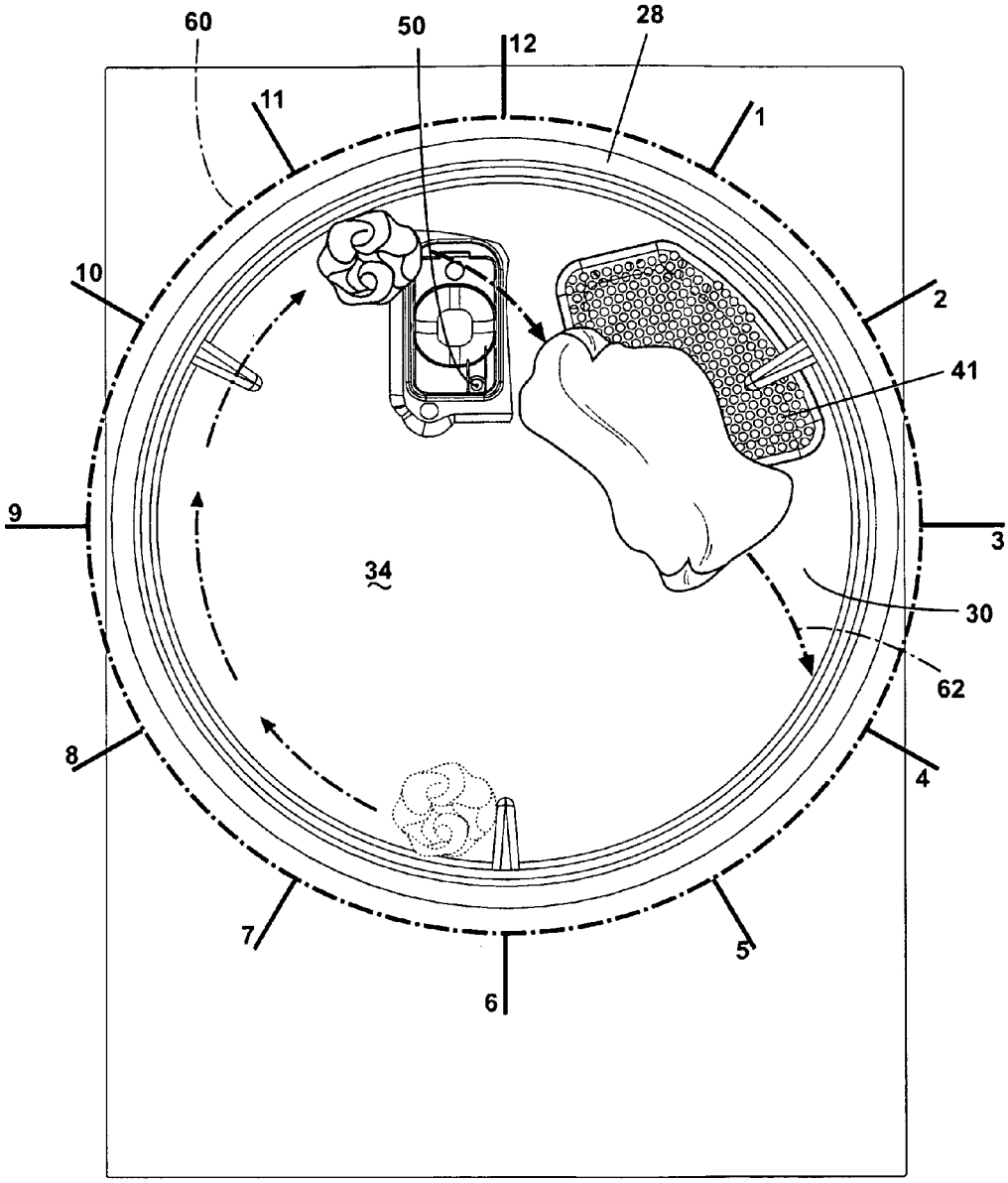
FIG. 6 is a second schematic view of the rear bulkhead of the dryer of FIG. 1 and having its operation controlled by the method.

Still referring to FIG. 6, an article may be carried to the 11 o'clock position by the drum 28 from the 6 o'clock position. The article may follow a trajectory attributable to the force of gravity acting on the laundry item to carry the article roughly to the 4 o'clock position. As illustrated, when the articles are tumbled in this manner, they may open up inside the drum 28 when they are directly in front of the inlet grill 41 where they pass through the air entering the drying chamber 34 to more effectively dry the laundry. Dryers, dispensing or not, operate at speed where the laundry will tumble in the drying chamber to promote the drying of the laundry. The tumbling aids in opening up the laundry items as they fall, which also improves the rate of drying. The condition where the load rises and falls with rotation of the drum 28 is known as tumbling of the load.

Figure 7:
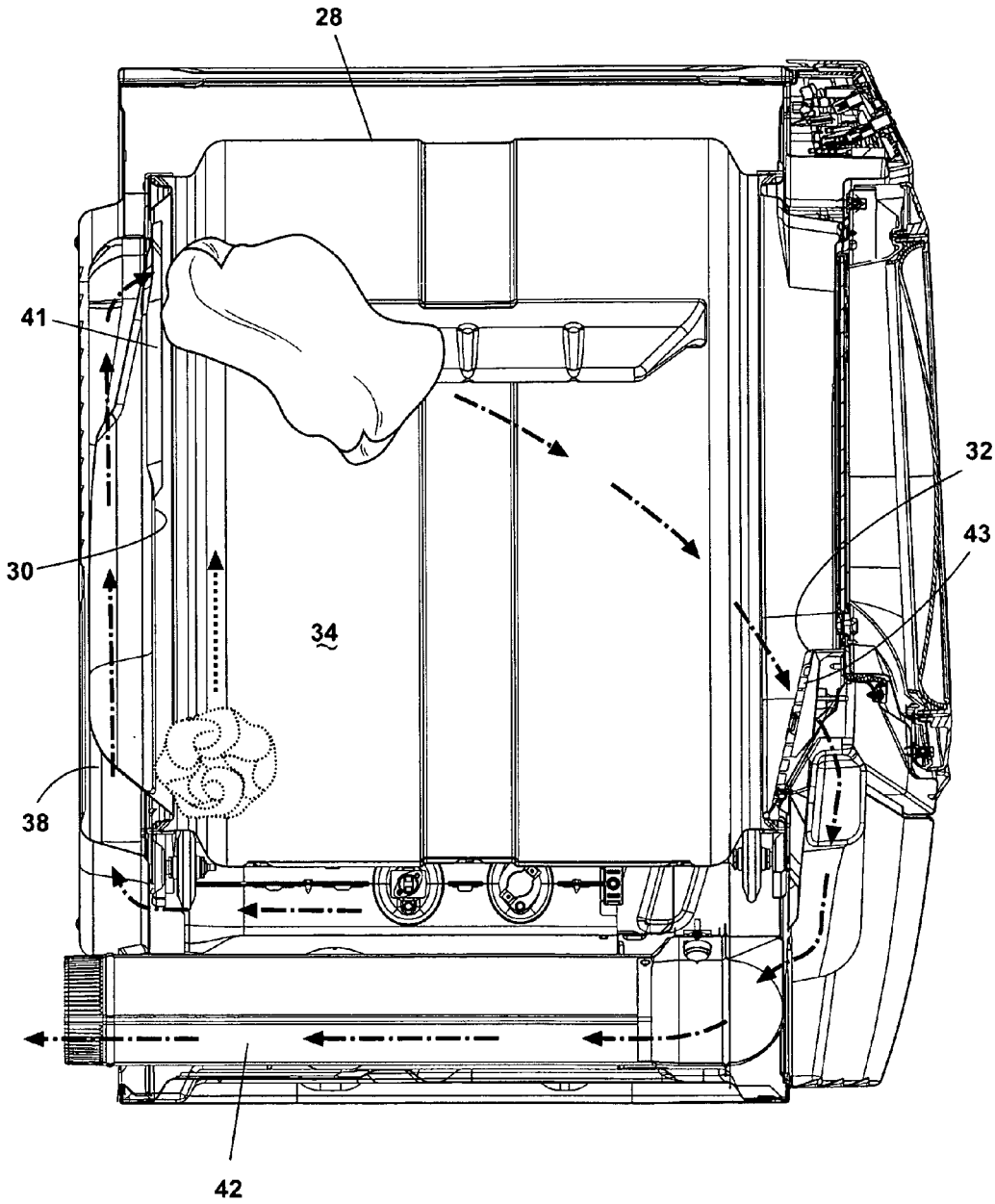
FIG. 7 is a partial side view of the dryer of FIG. 1 with portions of the cabinet removed and having its operation controlled by the method.

As the articles in the load rise and fall with the rotation of the drum 28, they may wipe the front and rear bulkheads 32 and 30. When articles are projected, they may slide against the surfaces of the rear and front bulkheads 30 and 32, and the inner surface of the door 26 and effectively wipe the treating chemistry from them. The balled article in FIG. 7 may wipe the rear bulkhead 30 as it travels from the 6 o'clock position at bottom of the drum 28 to the 11 o'clock position. Even as the article opens up in front of the inlet grill 41 it may act to wipe portions of the rear bulkhead 30 as it travels down again. Other articles, not illustrated, may act to wipe other portions of the drum 28 and front bulkhead 32. With multiple articles and over multiple revolutions most of the surface is wiped.

Figure 8:
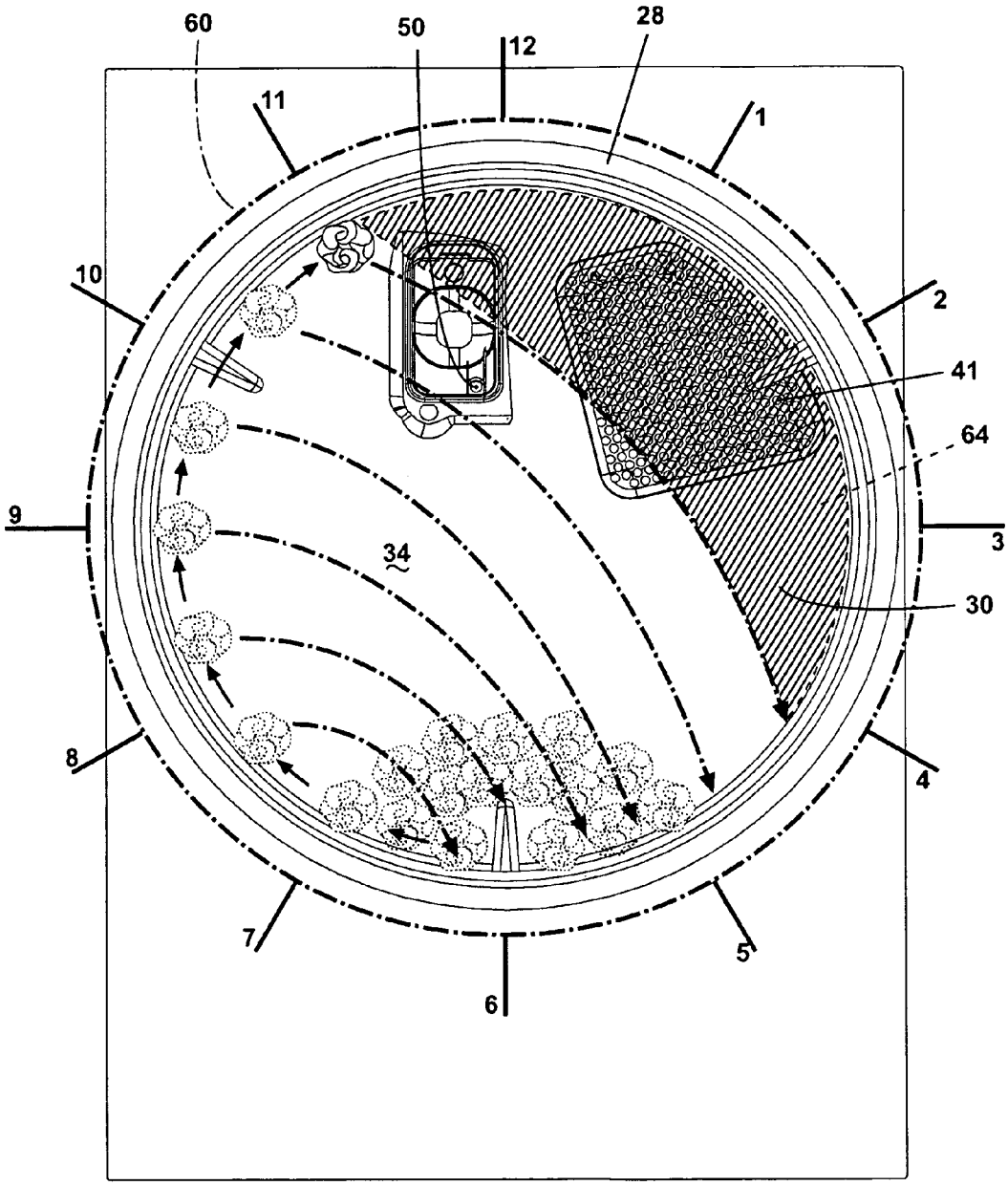
FIG. 8 is a third schematic view of the rear bulkhead of the dryer of FIG. 1 and having its operation controlled by the method.

Referring to FIG. 8, it may be seen that the wiping is an asymmetrical process. This is because most dryers are designed to rotate in only one direction. Thus, the dryer inlet 41 is location asymmetrically to create an inlet opposite where the clothes detach at the 11 o'clock position when the drum 28 is rotated at its normal speed during the drying cycle. Further, when the drum 28 is rotated at its normal speed the multiple articles may detach at various points up to the 11 o'clock position. Only the portions of the rear and front bulkheads 32 and 30 where the trajectories are shown are wiped. A first un-wiped portion 64, shown with shading lines, is not wiped when the drum is rotated at its normal speed in its normal direction.

Figure 9:
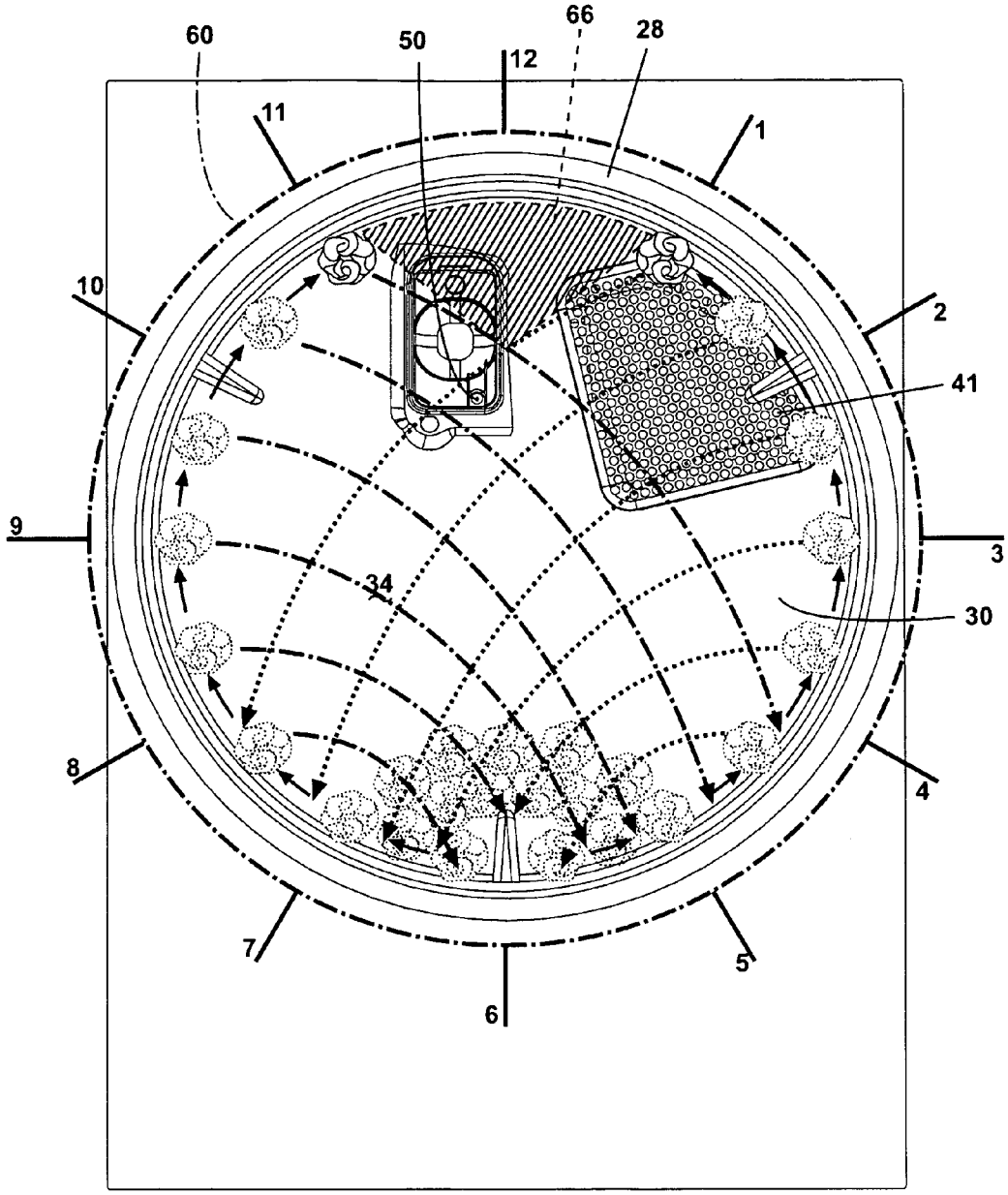
FIG. 9 is a fourth schematic view of the rear bulkhead of the dryer of FIG. 1 and having its operation controlled by the method.

To obtain a more complete wiping, the drum 28 may be rotated in a second, opposite, direction, as shown in FIG. 9. When the drum 28 is rotated in the second direction at the normal speed, the articles may be carried by the drum 28 up to the 1 o'clock position where they then detach and may be projected to the 8 o'clock position. FIG. 9 shows the projection of the articles in the drum 28 as the drum is rotated in both a first and second direction. The arrows signifying the projection of the articles illustrate which portions of the rear and front bulkheads 30 and 32, and the inner surface of the door 26 are cleaned as the articles come in contact with them. Though distinct arrows and lines are shown in the Figures the articles act to wipe a continuous area of the rear and front bulkheads 30 and 32, and the inner surface of the door 26. The arrows do not need to abut each other as the articles will wipe down a portion of the front and rear bulkheads 32 and 30 with their width.

It should be noted that by reversing the direction of rotation for the drum 28 more area of the front and rear bulkheads 32 and 30 is wiped. The tumbling laundry may even effectively wipe the entire drum 28 and portions of the rear and front bulkheads 30 and 32, and the inner surface of the door 26. However, because the articles are only carried to the 11 o'clock and 1 o'clock positions respectively the entire surface of the rear and front bulkheads 30 and 32, and the inner surface of the door 26 may not be wiped by the tumbling laundry during a normal drying cycle. A second un-wiped portion 66, shown with shading lines, of the front and rear bulkheads 32 and 30 is still not wiped during the normal speed rotation.

The wiping of the second un-wiped portion 66 of the rear and front bulkheads 30 and 32 may be accomplished by varying the rotation of the drum 28 such that an article detaches from the drum 28 between at least one of the ranges of 11 o'clock to 1 o'clock. When the article detaches between these ranges, it may fall within the drum 28 to form additional multiple trajectories relative to the front and rear bulkheads 32 and 30. These trajectories coincide to the portions of the front and rear bulkheads 32 and 30 that will be wiped by the falling article.

Figure 10:
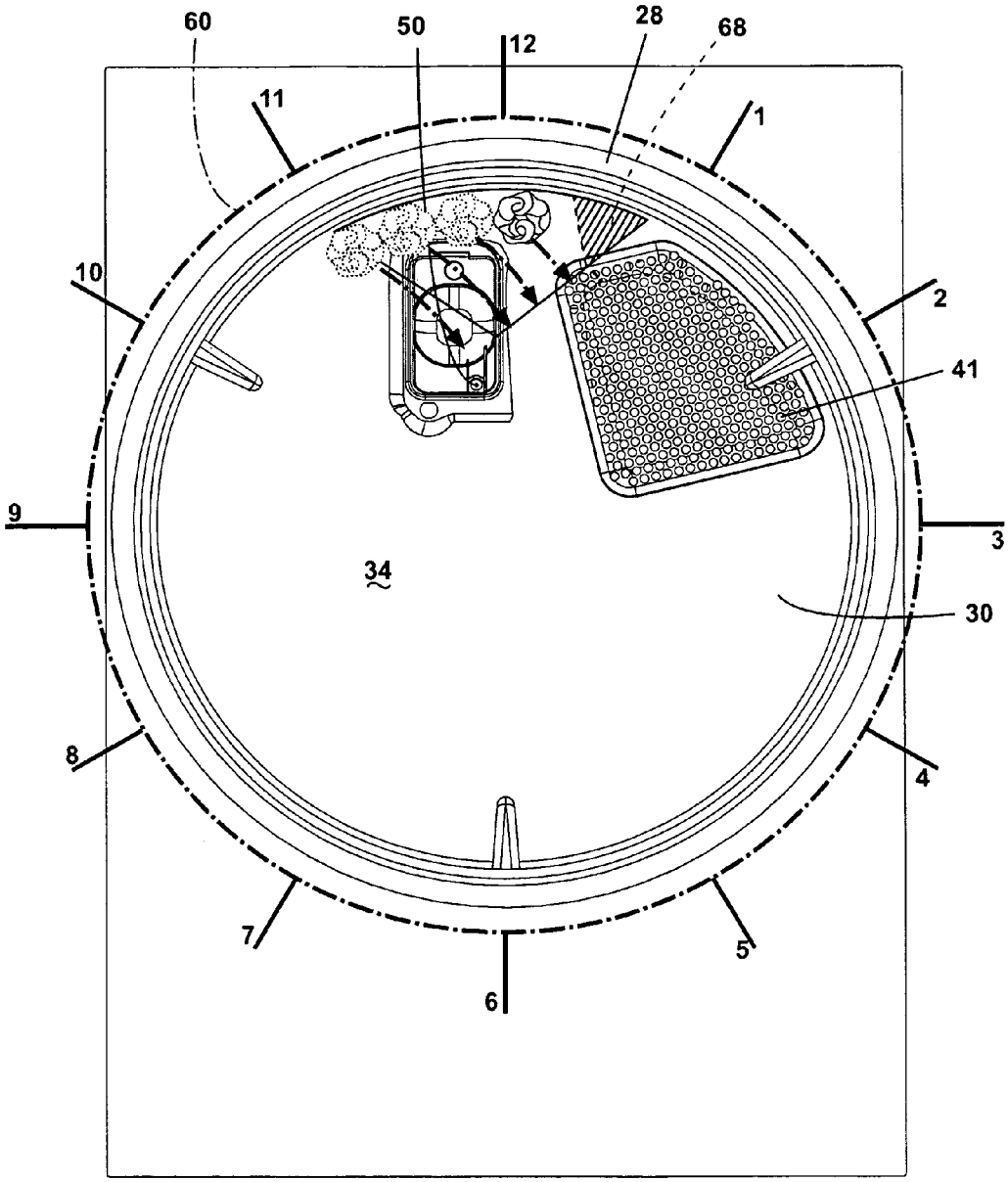
FIG. 10 is a fifth schematic view of the rear bulkhead of the dryer of FIG. 1 and having its operation controlled by the method.

Referring to FIG. 10, one way to vary the rotation to wipe the second un-wiped portion 66 is to increase the rotational speed of the drum 28 above the normal speed such that the laundry articles do not detach from the drum until around the 12 o'clock position. The speed at which the laundry articles being detaching around the 12 o'clock position is closely related to a rotational speed of the drum, referred to as the satellizing speed, which generally corresponds to a centripetal force equal to or greater than the force of gravity acting on the article. For an article to detach around the 12 o'clock position, the rotational speed of the drum should approach the satellizing speed for the article, but not exceed the satellizing speed for the article. If the satellizing speed for the article is exceed, the article will stay attached to the drum and not detach and form a trajectory across the second un-wiped portion 66.

Fortunately, the satellizing speed will vary for each article of laundry because the centripetal force is a function of the radius the center of mass of each article is from the axis of rotation of the drum and the mass of the article. Therefore, as the drum 28 is accelerated different articles of laundry will detach at different locations between the 11 and 12 o'clock positions. The acceleration rate of the drum 28 may be controlled such that the trajectories from the detaching articles span much of the second un-wiped portion 66. Such a control of the speed may be a control over the rate of acceleration.

However, depending on the size of the articles used, it is possible that not all of the second un-wiped portion 66 is wiped when this method is used in just one rotational direction, which is illustrated as clockwise in FIG. 10. This third un-wiped portion has been labeled as 68. Thus, it may be desired that the varying of the rotation of the drum 28 may also include selectively rotating the drum between clockwise and counterclockwise directions. If the drum 28 were to be rotated in FIG. 10 in both a clockwise and counterclockwise direction, the third un-wiped portion 68 would then be wiped and the entirety of the second un-wiped portion 66 of the front and rear bulkheads 32 and 30 would be wiped by the falling articles.

Figure 11:
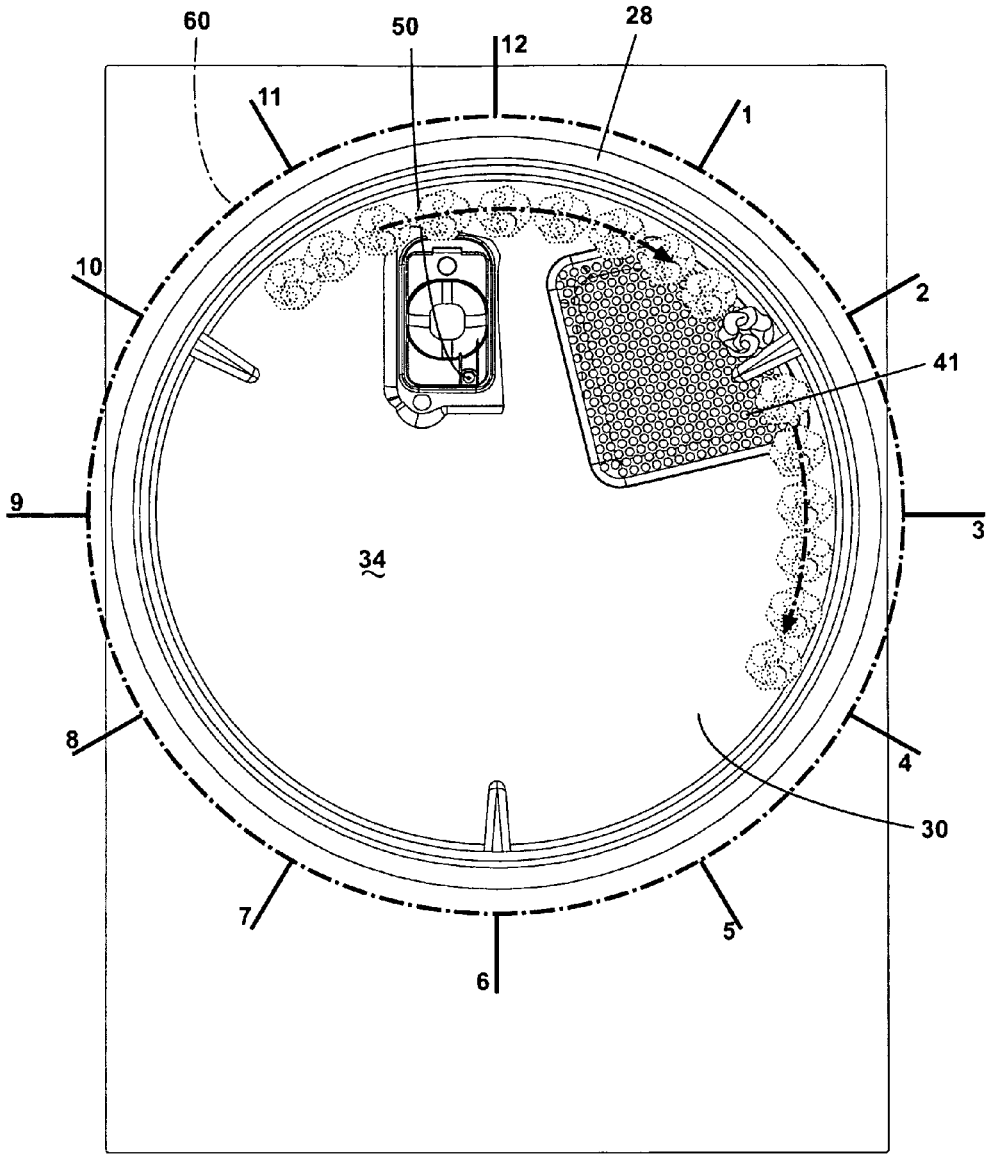
FIG. 11 is a sixth schematic view of the rear bulkhead of the dryer of FIG. 1 and having its operation controlled by the method.

Referring to FIG. 11, in addition to or as an alternative to the reversing the rotation between the clockwise and counterclockwise directions to wipe the third un-wiped portion 68, it is possible to continue the acceleration of the drum speed such that it exceeds the satellizing speed for at least some or all of the articles. The size of the articles is normally great enough such that they will wipe the third un-wiped portion 68.

Thus, to accomplish wiping the rear and front bulkheads 30 and 32 the drum 28 may be rotated such that the at least one article repeatedly detaches from the drum 28 and falls within the drum 28 to form multiple trajectories relative to the front and rear bulkheads 32 and 30 and varying the rotation such that the multiple trajectories collectively span the front and rear bulkheads 32 and 30. The different steps as described above may be combined in any number of ways to accomplish the wiping.

The varying of the rotation may include rotating the drum 28 in opposite directions. When the drum may be rotated in opposite directions, the rotation may be repeatedly alternated between the first and second opposite directions. The varying of the rotation may include increasing the speed of rotation up to a satellizing speed. Alternatively, the varying of the rotation may include increasing the speed of rotation at least to the satellizing speed.

For example, the rotation of the drum 28 could be slowly accelerated up to the satellizing speed in a first direction. Then the motor 44 may pause for a time to allow the drum 28 to slow down before rotating the drum 28 in a second opposite direction, again slowly accelerating up to the satellizing speed to accomplish improved wiping. Thus, the variation of the speed of rotation may be combined with varying the direction of rotation such that the drum 28 may be sped up to the satellizing speed for each of the opposite directions of rotation. The rotation of the drum 28 may be increased in a first direction up to a satellizing speed and then increased in a second direction, opposite the first direction, up to a satellizing speed. When the direction of rotation is changed there may be a portion of time where the article within the drum 28 will not be satellized and will be projected across a portion of the front and rear bulkheads 32 and 30 this also acts to wipe additional portions of the front and rear bulkheads 32 and 30.

Alternatively, the drum 28 could be rotated in only one direction up past the satellizing speed. The drum 28 may be accelerated slowly enough to ensure that the fabric articles have had time to wipe the surfaces of the front and rear bulkheads 32 and 30. The drum 28 may also be sped up and slowed down in this manner in each direction or both directions.

The laundry may wipe treating chemistry that was dispensed in the current operating cycle or in a prior cycle of operation. The operation of the dispensing dryer 10 to wipe the front and rear bulkheads may be part of a drying cycle of operation or a part of a wiping cycle of operating that is separate from the drying cycle. Additionally, if the wiping is accomplished during the drying cycle the wiping operation may occur either at the beginning or at the end of the drying cycle.

Treating chemistries may buildup on the surfaces of the rear and front bulkheads 30 and 32, and the inner surface of the door 26, which may negatively impact reliability and performance. For example, not all of the treating chemistries are compatible and, when mixed, may impact the efficacy of the treating chemistries. Thus, residue from one of the chemistries may negatively impact the performance of the currently dispensed chemistry. The methods described above will help to cleanout the dispensing dryer 10 and avoid these negative consequences.

While the invention has been specifically described in connection with certain specific embodiments thereof, it may be understood that this is by way of illustration and not of limitation, and the scope of the appended claims should be construed as broadly as the prior art will permit.

What is claimed is:

1. A method for removing treating chemistry buildup in a dispensing dryer having a drying chamber configured to receive at least one article for drying, and defined by stationary front and rear bulkheads and a rotatable drum extending between the front and rear bulkheads, the method comprising:

wiping to remove residual treating chemistry from the front and rear bulkheads by:

rotating the drum such that the at least one article repeatedly detaches from the drum and falls within the drum to form multiple trajectories relative to the front and rear bulkheads, and varying the rotation such that the multiple trajectories collectively span the front and rear bulkheads.

2. The method of claim 1 wherein the varying the rotation comprises rotating the drum in opposite directions.

3. The method of claim 2 wherein the rotating the drum in opposite directions comprises repeatedly alternating the rotation between the opposite directions.

4. The method of claim 2 wherein the varying the rotation comprises increasing a speed of rotation up to a satellizing speed.

5. The method of claim 4 wherein the varying the rotation comprises increasing the speed of rotation at least to the satellizing speed.

6. The method of claim 4 wherein the increasing the speed of rotation up to the satellizing speed is done for each of the opposite directions of rotation.

7. The method of claim 1 wherein the varying the rotation comprises increasing a speed of rotation up to a satellizing speed.

8. The method of claim 7 wherein the varying the rotation comprises increasing the speed of rotation at least to the satellizing speed.

9. The method of claim 1 wherein the varying the rotation comprises increasing the speed of rotation in a first direction up to a satellizing speed and then increasing the speed of rotation in a second direction, opposite the first direction, up to a satellizing speed.

10. The method of claim 1 wherein the varying the rotation occurs after the dispensing of a treating chemistry into the drying chamber.

11. The method of claim 10 wherein the dispensing of the treating chemistry occurred in a prior cycle of operation.

12. The method of claim 10 wherein the wiping of the front and rear bulkheads is one of: part of a drying cycle of operation or part of a wiping cycle of operation.

13. The method of claim 12 wherein the wiping occurs at one of the beginning and end of the one of the part of a drying cycle.

14. A method for removing treating chemistry buildup in a dispensing dryer having a drying chamber configured to receive at least one article for drying; and defined by stationary front and rear bulkheads and a rotatable drum extending between the front and rear bulkheads, with the drum having a circular cross section and bounding a circular area of each of the front and rear bulkheads, on which may be imposed a conceptual clock face having 12 o'clock at the high point and 6 o'clock at the low point, the method comprising:

varying the rotation of the drum such that the at least one article detaches from the drum between at least one of the ranges of 11 o'clock to 12 o'clock and 12 o'clock to 1 o'clock and wipes a corresponding portion of one of the front and rear bulkheads to remove residual treating chemistry therefrom.

15. The method of claim 10 wherein the varying the rotating comprises rotating the drum such that the at least one article detaches from the drum at the 12 o'clock position.

16. The method of claim 10 wherein the varying the rotation comprises selectively rotating the drum between clockwise and counterclockwise directions.

17. The method of claim 14 wherein the varying the rotation occurs after the dispensing of a treating chemistry into the drying chamber.

18. The method of claim 17 wherein the dispensing of the treating chemistry occurred in a prior cycle of operation.

19. The method of claim 17 wherein the varying the rotation is one of: part of a drying cycle of operation or part of a wiping cycle of operation.

20. The method of claim 19 wherein the wiping occurs at one of the beginning and end of the one of the part of a drying cycle.

* * * * *

UNITED STATES PATENT AND TRADEMARK OFFICE

CERTIFICATE OF CORRECTION

PATENT NO. : 8,209,879 B2
APPLICATION NO. : 12/489539
DATED : July 3, 2012
INVENTOR(S) : Fredrick E. Chernetski et al.

It is certified that error appears in the above-identified patent and that said Letters Patent is hereby corrected as shown below:

In the Claims:

Col. 9, lines 7-20, Claim 14: "A method for removing treating chemistry buildup in a dispensing dryer having a drying chamber configured to receive at least one article for drying; and defined by stationary front and rear bulkheads and a rotatable drum extending between the front and rear bulkheads, with the drum having a circular cross section and bounding a circular area of each of the front and rear bulkheads, on which may be imposed a conceptual clock face having 12 o'clock at the high point and 6 o'clock at the low point, the method comprising: varying the rotation of the drum such that the at least one article detaches from the drum between at least one of the ranges of 11 o'clock to 12 o'clock and 12 o'clock to 1 o'clock and wipes a corresponding portion of one of the front and rear bulkheads to remove residual treating chemistry therefrom." - should be Claim 14: -- A method for removing treating chemistry buildup in a dispensing dryer having a drying chamber configured to receive at least one article for drying, and defined by stationary front and rear bulkheads and a rotatable drum extending between the front and rear bulkheads, with the drum having a circular cross section and bounding a circular area of each of the front and rear bulkheads, on which may be imposed a conceptual clock face having 12 o'clock at the high point and 6 o'clock at the low point, the method comprising: varying the rotation of the drum such that the at least one article detaches from the drum between at least one of the ranges of 11 o'clock to 12 o'clock and 12 o'clock to 1 o'clock and wipes a corresponding portion of one of the front and rear bulkheads to remove residual treating chemistry therefrom. --

Signed and Sealed this
Twenty-first Day of August, 2012

David J. Kappos

David J. Kappos
*Director of the United States Patent and Trademark Office*